US008753450B2

(12) United States Patent
Norton et al.

(10) Patent No.: US 8,753,450 B2
(45) Date of Patent: Jun. 17, 2014

(54) TREATMENT PROCESS FOR AN ISOMERIZATION UNIT

(71) Applicant: UOP LLC, Des Plaines, IL (US)

(72) Inventors: Ralph Charles Norton, Mission Viejo, CA (US); Dana K. Sullivan, Mount Prospect, IL (US); Jocelyn C. Daguio, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 13/922,283

(22) Filed: Jun. 20, 2013

(65) Prior Publication Data

US 2013/0276825 A1 Oct. 24, 2013

Related U.S. Application Data

(62) Division of application No. 13/243,825, filed on Sep. 23, 2011.

(51) Int. Cl.

| | |
|---|---|
| ***C23G 1/02*** | (2006.01) |
| ***C23G 1/10*** | (2006.01) |
| ***B08B 3/08*** | (2006.01) |
| ***B08B 9/08*** | (2006.01) |

(52) U.S. Cl.

USPC ..... 134/3; 134/22.1; 134/41

(58) Field of Classification Search

USPC ..... 134/22.1, 3, 41; 423/481, 486

See application file for complete search history.

(56) References Cited

U.S. PATENT DOCUMENTS

| | | | | |
|---|---|---|---|---|
| 2,436,564 | A * | 2/1948 | Gerbes | 585/742 |
| 2,473,472 | A * | 6/1949 | Gorin et al. | 585/318 |
| 3,299,165 | A * | 1/1967 | Abrahamson | 585/748 |
| 3,892,818 | A * | 7/1975 | Scharfe et al. | 423/481 |

* cited by examiner

*Primary Examiner* — Michael Kornakov
*Assistant Examiner* — Natasha Campbell
(74) *Attorney, Agent, or Firm* — Maryann Maas

(57) ABSTRACT

One exemplary embodiment can be a process for treating an interior of equipment for an isomerization unit. Generally, the isomerization unit includes at least one of a drying zone, an isomerization reaction zone, and a stabilizer zone, for receiving a feed stream. Usually, the feed stream includes one or more C4-C8 hydrocarbons. The process can include combining an anhydrous hydrogen stream and anhydrous organic chloride stream to form a hydrogen chloride feedstock, and passing the hydrogen chloride feedstock to a reaction zone containing a catalyst including at least one of nickel, palladium, and platinum on an alumina support to form a hydrogen chloride stream, and passing the hydrogen chloride stream upstream of the isomerization reaction zone.

2 Claims, 1 Drawing Sheet

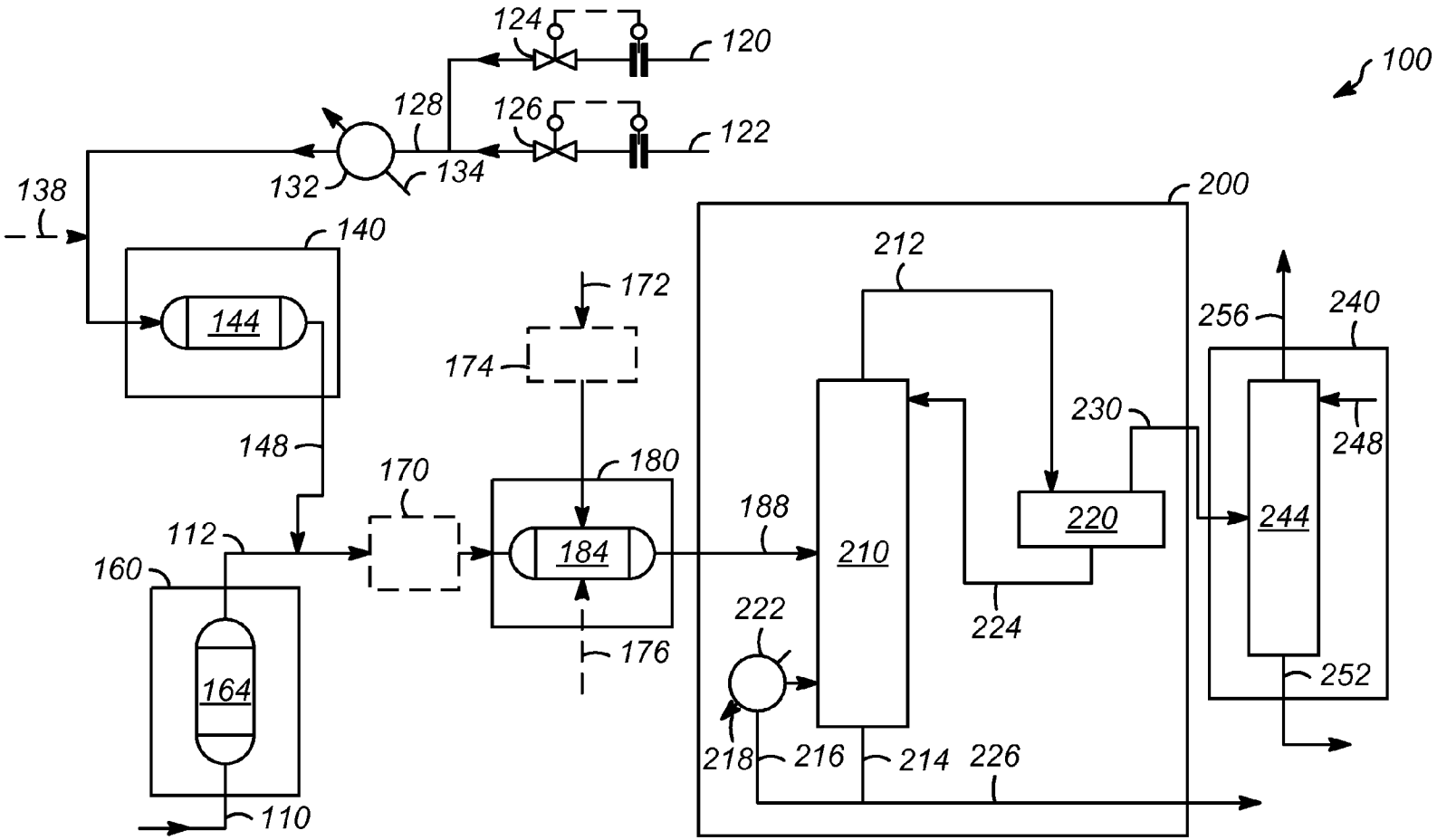
100
200
210
212
214
216
218
220
222
224
226
230
240
244
248
252
256
110
112
120
122
124
126
128
132
134
138
140
144
148
160
164
170
172
174
176
180
184
188

TREATMENT PROCESS FOR AN ISOMERIZATION UNIT

CROSS REFERENCE TO RELATED APPLICATION

This application is a Division of copending application Ser. No. 13/243,825 filed Sep. 23, 2011, the contents of which are hereby incorporated by reference in its entirety.

FIELD OF THE INVENTION

This invention generally relates to a treatment process for an isomerization unit.

DESCRIPTION OF THE RELATED ART

Generally, isomerization units prior to start-up have an interior of their equipment exposed to air and/or water. As such, the equipment is generally treated to convert any oxides to halides. Such treatments often require the purchase and shipment of significant amounts of an anhydrous hydrogen chloride to chemically treat the interior of the equipment to convert metal oxides, such as rust, to metal chlorides. Due to the hazards associated with shipping and storing of hydrogen chloride, along with increasing government regulations, such materials are difficult and expensive to obtain and handle. As a consequence, there is a desire to find another suitable mechanism for providing a treating substance to the isomerization unit.

SUMMARY OF THE INVENTION

One exemplary embodiment can be a process for treating an interior of equipment for an isomerization unit. Generally, the isomerization unit includes at least one of a drying zone, an isomerization reaction zone, and a stabilizer zone, for receiving a feed stream. Usually, the feed stream includes one or more C4-C8 hydrocarbons. The process can include combining an anhydrous hydrogen stream and an anhydrous organic chloride stream to form a hydrogen chloride feedstock, passing the hydrogen chloride feedstock to a reaction zone containing a catalyst including at least one of nickel, palladium, and platinum on an alumina support to form a hydrogen chloride stream, and passing the hydrogen chloride stream upstream of the isomerization reaction zone.

Another exemplary embodiment may be a process for performing maintenance for an isomerization unit. The process can include passing a feed stream including one or more C4-C8 hydrocarbons to the isomerization unit, shutting the feed stream to the isomerization unit, replacing catalyst in an isomerization reactor in the isomerization reaction zone, combining an anhydrous hydrogen stream and anhydrous organic chloride stream to form a hydrogen chloride feedstock, passing the hydrogen chloride feedstock to a reaction zone to form a hydrogen chloride stream, and passing the hydrogen chloride stream upstream of an isomerization reaction zone. Typically, air is introduced into the isomerization reactor during replacing the catalyst.

A further exemplary embodiment can be a process for treating an interior of equipment for an isomerization unit. Usually, the isomerization unit includes at least one of a drying zone, an isomerization reaction zone, and a stabilizer zone, for receiving a feed stream. Typically, the feed stream includes one or more C4-C8 hydrocarbons. The process can include passing an anhydrous organic chloride stream including perchloroethane to a pyrolysis reaction zone containing ceramic rings at a temperature of about 340- about 600° C. to form a hydrogen chloride stream, and passing the hydrogen chloride stream upstream of the isomerization reaction zone.

The embodiments disclosed herein can provide two chemicals that are typically used in manufacturing or refining facilities, such as an isomerization unit, along with some additional equipment to generate anhydrous hydrogen chloride as required during start-up for initiating unit operations or after maintenance. As such, manufacturing the anhydrous hydrogen chloride on site can eliminate shipping hazards and storage complications by providing the anhydrous hydrogen chloride just-in-time with little or no inventory.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$" means one or more hydrocarbon molecules of three carbon atoms and/or more. Alternatively or additionally, the stream may contain non-hydrocarbon fluids, such as hydrogen, water, and/or hydrogen chloride.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally about 50%, and preferably about 70%, by mole, of a compound or class of compounds in a stream.

As used herein, the term "substantially" can mean an amount of at least generally about 80%, and preferably about 90%, by mole, of a compound or class of compounds in a stream.

As used herein, the term "parts per million" may be abbreviated "ppm".

As used herein, the terms "alkane" and "paraffin" may be used interchangeably.

As used herein, the term "anhydrous" generally means no more than about 100 ppm, by weight, of water in a substance or a stream.

As depicted, process flow lines in the figures can be referred to, interchangeably, as, e.g., lines, pipes, streams, feeds, feedstocks, effluents, and products.

BRIEF DESCRIPTION OF THE DRAWING

The FIGURE is a schematic depiction of an exemplary isomerization unit.

DETAILED DESCRIPTION

Referring to the FIGURE, an isomerization unit 100 can include a reaction zone 140, at least one drying zone 160, at least one isomerization reaction zone 180, at least one stabilizer zone 200, and a scrubbing zone 240. In addition, an isomerization unit 100 can include other equipment upstream of the at least one drying zone 160, such as one or more benzene saturation reactors that can receive a hydrocarbon feed and a hydrogen stream and one or more sulfur guard beds on each of these feeds. In addition, the benzene saturation reactor may also be associated with one or more feed/effluent exchangers as well as an evaporator cooler and a receiver for the benzene saturation reactor effluent. Particularly, the receiver can remove light ends from the benzene saturation reactor effluent prior to being provided as a feed stream 110 including one or more C4-C8 hydrocarbons. An exemplary isomerization unit is disclosed in, e.g., U.S. application Ser. No. 13/005,940 filed 13 Jan. 2011. As hereinafter described, anhydrous hydrogen chloride may be utilized for treating the isomerization unit 100, although other compounds, such as other acids, may also be utilized or in place therefor.

During manufacturing operations, a feed stream 110 can be provided to the at least one drying zone 160 containing a dryer 164. The dried feed stream 112 can then be provided to another drying zone 170 if a chloride stream 176 is provided to the at least one isomerization reaction zone 180. Similarly, a makeup gas stream 172 may also be provided to an optional further drying zone 174 before entering the at least one isomerization reaction zone 180. If the at least one isomerization reaction zone 180 does not include a halided catalyst, then the chloride stream 176 can be omitted as well as the drying zones 170 and 174.

The at least one isomerization reaction zone 180 can include an isomerization reactor 184 that produces an isomerization zone effluent 188. If a halided, such as a chlorided, catalyst is utilized, an exemplary isomerization reaction zone 180 is disclosed in, e.g., U.S. Pat. No. 7,223,898. In such an isomerization reaction zone 180, the gas often separated in the stabilizer zone 200, as hereinafter described, can be scrubbed prior to being discharged.

The isomerization reaction zone 180 can include one or more exemplary catalysts disclosed in, e.g., U.S. Pat. No. 7,223,898 B2 and U.S. Pat. No. 5,326,926. A combined feed may be contacted in the isomerization reaction zone 180 with an isomerization catalyst. Such a catalyst can be a halided catalyst, such as a chlorided platinum alumina catalyst. The alumina can be an anhydrous gamma-alumina, although other aluminas may be utilized. In addition to platinum, the catalyst may optionally include one or more of palladium, germanium, ruthenium, rhodium, osmium, and iridium. The catalyst may contain from about 0.1- about 0.25%, by weight, platinum, and optionally about 0.1- about 0.25%, by weight, one or more of palladium, germanium, ruthenium, rhodium, osmium, and iridium, based on the weight of the catalyst. Such an exemplary catalyst is disclosed in, e.g., U.S. Pat. No. 5,326,926.

If a non-halided catalyst is utilized, the drying zones 170 and 174 and the chloride stream 176 can be omitted, as discussed above. Particularly, the streams 112 and 172 can proceed directly to the isomerization reaction zone 180 without drying. Catalysts incorporated in such zones are disclosed in, e.g., U.S. Pat. No. 7,223,898 B2.

Another suitable isomerization catalyst is a solid strong acid catalyst, which may include a sulfated support of an oxide or hydroxide of a group 4 metal, preferably a zirconium oxide or hydroxide, at least a first component of a lanthanide element or yttrium, and at least a second component being a platinum-group metal, such as at least one element of platinum, palladium, ruthenium, rhodium, iridium, and osmium. The group 4 metal may include titanium, zirconium, halfnium, and/or dubnium. The catalyst optionally contains an inorganic-oxide binder, such as alumina. An exemplary catalyst is a sulfated zirconia catalyst.

The support material of the solid strong acid catalyst can include an oxide or a hydroxide of a group 4 metal. In one exemplary embodiment, the group 4 element is zirconium or titanium. Sulfate may be composited on the support material. A component of a lanthanide-series element or yttrium can be incorporated into the composite using any suitable means. The lanthanide series element component may be one or more of lanthanum, cerium, praseodymium, neodymium, promethium, samarium, europium, gadolinium, terbium, dysprosium, holmium, erbium, thulium, ytterbium and lutetium. A suitable amount of the lanthanide series component may be about 0.01- about 10%, by weight, on an elemental basis, based on the weight of the catalyst. A platinum-group metal component may be added to the catalytic composite by any suitable means, such as impregnation. The platinum-group metal component may be one or more of platinum, palladium, ruthenium, rhodium, iridium, and osmium, in an amount of about 0.01- about 2%, by weight, of the platinum-group metal component, on an elemental basis based on the weight of the catalyst.

Optionally, the catalyst is bound with a refractory inorganic oxide. The binder, when employed, usually comprises from about 0.1- about 50%, preferably about 5- about 20%, by weight, based on the weight of the finished catalyst. The support, sulfate, metal components and optional binder may be composited in any order effective to prepare a catalyst useful for the isomerization of hydrocarbons. Examples of suitable atomic ratios of lanthanide or yttrium to platinum-group metal may be at least about 1:1; preferably about 2:1. Optionally, the catalyst may further include a third component of iron, cobalt, nickel, rhenium or a mixture thereof. As an example, iron may be present in an amount of about 0.1- about 5%, by weight, on an elemental basis based on the weight of the catalyst. In one exemplary embodiment, the solid strong acid isomerization catalyst may be sulfated zirconia or a modified sulfated zirconia.

The at least one isomerization reaction zone 180 can be operated at any suitable conditions, such as a temperature of about 40- about 235° C. and a pressure of about 700- about 7,000 kPa. The feed rate to the isomerization reaction zone 180 can also vary over a wide range, including a liquid hourly space velocity ranging from about 0.5- about 12 $hr^{-1}$.

The isomerization zone effluent 188 can pass to the at least one stabilizer zone 200. Generally, the stabilizer zone 200 can include a stabilizer column 210 operating at a temperature of about 140- about 210° C., and a pressure of about 790- about 2,100 kPa. Generally, the stabilizer column 210 can include a receiver 220 and a reboiler 222. Usually, the isomerization zone effluent 188 enters the stabilizer column 210 with a portion passing as an overhead stream 212. The overhead stream 212 may be passed to the receiver 220 with a reflux stream 224 exiting the bottom of the receiver 220 and then returning to the stabilizer column 210. Another part of the overhead stream 212 can pass as a gas stream 230 to the scrubbing zone 240, as hereinafter described. The heavier portions of the isomerization zone effluent 188 can exit as a stripper bottom stream 214 at a temperature of about 115- about 162° C., preferably about 140- about 210° C.

The stripper bottom stream 214 can be split into a reboiling stream 216 and a product stream 226 that typically contains isomerized C4 and/or C5 hydrocarbons. The reboiling stream 216 can pass through the reboiler 222 to provide the requisite duty to the stabilizer column 210. Generally, the reboiler 222 can utilize a heating stream 218 from any suitable heat source, such as another process stream or pressurized steam.

The gas stream 230 can enter the scrubbing zone 240. The scrubbing zone 240 can include a scrubber 244 receiving any suitable wash water stream 248, including water. Typically, the wash water stream 248 can remove any undesirable contaminants, such as halides or sulfur. A waste water stream 252 at the bottom and a fuel gas stream 256 from the top can exit the scrubber 244.

During construction or maintenance of the isomerization unit 100, the isomerization reactor 184 can be opened permitting air to enter one or more equipment items in the zones 180, 200, and 240. Moreover, water is often used to clean the internals of various equipment, including the isomerization reactor 184. The fluids of air and/or water can create undesired metal oxides in the equipment, namely oxygen can react with metal components of the equipment. This rusting of the equipment is undesirable, as these metal oxides can remain in the unit and cause undesirable reactions during process operations. As a consequence, during start-up, it is desired to purge the metal oxides prior to operation of the unit.

During shutdown of ongoing operations, often the feed stream 110 can be shut in or diverted to other destinations, such as storage. A hydrogen chloride stream 148 can be provided upstream of the isomerization zone 180 prior to operating the isomerization unit 100 and after vessels have been opened and closed. The hydrogen chloride stream 148 can be manufactured by providing an anhydrous hydrogen stream 120, having no more than about 100 ppm, by weight, water and an anhydrous organic chloride stream 122, having no more than about 100 ppm, by weight, water based on the weight of the anhydrous organic chloride stream 122.

The anhydrous organic chloride stream 122 can include one or more perchloro C1-C4 hydrocarbons, and typically the anhydrous organic chloride stream 122 includes at least about 99%, by weight, one or more perchloro C1-C4 hydrocarbons based on the weight of the anhydrous organic chloride stream 122, or the anhydrous organic chloride stream 122 can include one or more perchloro C2-C3 hydrocarbons and preferably includes perchloroethane. The streams 120 and 122 can pass through respective flow control valves 124 and 126 and be combined into a hydrogen chloride feedstock 128. The hydrogen chloride feedstock 128 can be passed through a heater 132 using any suitable heating stream 134, such as steam or another process stream.

The heated hydrogen chloride feedstock 128 can optionally receive a hydrogen stream 138. Desirably, the heated hydrogen chloride feedstock 128 has about 400- about 5,000%, by mole, hydrogen based on the total moles of the anhydrous organic chloride stream 122. Subsequently, this hydrogen chloride feedstock 128 can be provided to the reaction zone 140 that may include a reactor 144. In one exemplary embodiment, the reaction zone can be a pyrolysis reaction zone 140 containing ceramic rings and operated at a temperature of about 40- about 235° C., a pressure of about 700- about 7,000 kPa, and a flow rate of organic chloride of about 0.5- about 50 $hr^{-1}$. The pyrolysis reaction zone 140 can convert the organic chloride into hydrogen chloride. Thus, the hydrogen chloride stream 148, preferably anhydrous, can be provided from the reaction zone 140.

Alternatively, the catalyst can be at least one of nickel, palladium, and platinum deposited on an inert support, such as alumina or silica. The heater 132 can be provided to heat the hydrogen chloride feedstock 128 to the requisite temperature. The operating conditions can include a temperature of about 40- about 235° C., a pressure of about 700- about 7,000 kPa, and a flow rate of organic chloride of about 0.5- about 50 $hr^{-1}$.

Generally, the organic chloride can decompose to a hydrocarbon and anhydrous hydrogen chloride. Preferably, the anhydrous hydrogen chloride stream 148 has no more than about 100 ppm, preferably no more than about 10 ppm, by weight, water. Although the anhydrous hydrogen chloride can be sent to multiple points within the isomerization unit 100, in one preferred embodiment the hydrogen chloride stream 148 can be provided downstream of the drying zone 160, but upstream of the isomerization zone 180. The hydrogen chloride stream 148 can pass through the zones 180, 200, and 240, entering the equipment included in the zones. Particularly, the hydrogen chloride stream 148 can pass through the isomerization reactor 184, the stabilizer column 210, the reboiler 222, the receiver 220, and the scrubber 244. As such, iron oxide may be converted to iron chloride and thus rust can be reduced within the isomerization unit 100. In the scrubber 244, the hydrogen chloride can enter this vessel and be contacted with the wash water stream 248. The hydrogen chloride can then exit the isomerization unit 100 with the waste water stream 252 that can include at least a portion of the hydrogen chloride stream 148. Afterwards, procedures for starting-up the isomerization unit 100 can continue.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for treating an interior of equipment for an isomerization unit, wherein the isomerization unit comprises a pyrolysis reaction zone containing ceramic rings, and further comprises at least one of a drying zone, an isomerization reaction zone, and a stabilizer zone, for receiving a feed stream comprising one or more C4-C8 hydrocarbons, comprising:

A) passing an anhydrous organic chloride stream comprising perchloroethane to the pyrolysis reaction zone at a temperature of about 340- about 600° C. to form a hydrogen chloride stream; and B) passing the hydrogen chloride stream upstream of the isomerization reaction zone.

2. The process according to claim 1, further comprising passing the hydrogen chloride stream to at least one stabilizer zone.

* * * * *